US007850545B2

(12) United States Patent
Wada et al.

(10) Patent No.: US 7,850,545 B2
(45) Date of Patent: Dec. 14, 2010

(54) GOLF CLUB HEAD

(75) Inventors: Kozue Wada, Chichibu (JP); Hiroshi Takahashi, Chichibu (JP); Wataru Ban, Chichibu (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 44 days.

(21) Appl. No.: 12/196,466

(22) Filed: Aug. 22, 2008

(65) Prior Publication Data

US 2010/0048324 A1 Feb. 25, 2010

(51) Int. Cl.
*A63B 53/04* (2006.01)

(52) U.S. Cl. ..... 473/332; 473/345

(58) Field of Classification Search ..... 473/324–350
See application file for complete search history.

(56) References Cited

U.S. PATENT DOCUMENTS

| | | | | |
|---|---|---|---|---|
| 5,346,218 | A | 9/1994 | Wyte | |
| 5,482,279 | A * | 1/1996 | Antonious | 473/327 |
| 5,941,782 | A | 8/1999 | Cook | |
| 6,524,194 | B2 * | 2/2003 | McCabe | 473/305 |
| 6,783,465 | B2 | 8/2004 | Matsunaga | |
| 6,783,466 | B2 | 8/2004 | Seki et al. | |
| 6,949,031 | B2 | 9/2005 | Imamoto et al. | |
| 7,156,750 | B2 | 1/2007 | Nishitani et al. | |
| 7,207,898 | B2 * | 4/2007 | Rice et al. | 473/329 |
| 7,273,423 | B2 | 9/2007 | Imamoto | |
| 2002/0082117 | A1 | 6/2002 | Nishitani et al. | |

FOREIGN PATENT DOCUMENTS

| | | | |
|---|---|---|---|
| JP | 7-284546 | A | 10/1995 |
| JP | 10-24128 | A | 1/1998 |
| JP | 10-295859 | A | 11/1998 |
| JP | 11-299937 | A | 11/1999 |
| JP | 11-347157 | A | 12/1999 |
| JP | 2000-5351 | A | 1/2000 |
| JP | 2000-176056 | A | 6/2000 |
| JP | 2001104525 | A * | 4/2001 |
| JP | 2002-78833 | A | 3/2002 |
| JP | 2002-113135 | A | 4/2002 |
| JP | 2002-186691 | A | 7/2002 |
| JP | 2003-24481 | A | 1/2003 |

(Continued)

*Primary Examiner*—Alvin A Hunter
(74) *Attorney, Agent, or Firm*—Sughrue Mion, PLLC

(57) ABSTRACT

There is provided a golf club head that produces a loud hitting sound satisfying the golfer even if the volume of the golf club head having a hollow structure is increased to at least about 400 cc. A golf club head 1 having a hollow structure comprises a face part 2, a side part 3 comprising a back side, a sole part 4, a crown part 5, and a hosel part 9 having a shaft insertion hole, and the crown part 5. The crown part comprises a thick region 6 and a thin region 8. The thick region 6 extends through a distance $W_A$ of at least about 20 mm from the center axis line C of the shaft insertion hole toward the highest point T of the crown part 5 and extends through a distance $W_B$ of at least about 30 mm from the center axis line C of the shaft insertion hole toward the back side so that the crown part 5 has the first-order natural frequency of at least about 3000 Hz.

16 Claims, 9 Drawing Sheets

FOREIGN PATENT DOCUMENTS

| | | | |
|---|---|---|---|
| JP | 2003-52866 | A | 2/2003 |
| JP | 2003-88601 | A | 3/2003 |
| JP | 2003-102877 | A | 4/2003 |
| JP | 2004-65660 | A | 3/2004 |
| JP | 2004-222792 | A | 8/2004 |
| JP | 2004-229820 | A | 8/2004 |
| JP | 2005-160947 | A | 6/2005 |
| JP | 2007-54166 | A | 3/2007 |
| JP | 2007-54195 | A | 3/2007 |
| JP | 2007-54196 | A | 3/2007 |
| JP | 2007-54198 | A | 3/2007 |
| JP | 2007-54199 | A | 3/2007 |
| JP | 2007-54200 | A | 3/2007 |
| JP | 2007-151758 | A | 6/2007 |
| JP | 2007-167622 | A | 7/2007 |
| JP | 2007-175079 | A | 7/2007 |

* cited by examiner

GOLF CLUB HEAD

BACKGROUND OF THE INVENTION

The present invention relates to a metallic golf club head having a hollow space.

Conventionally, since the head of a driver has been made of stainless steel, the head volume has been as small as 150 to 200 cc. Since the hitting sound of this head is too loud, urethane foam or the like has been contained in the hollow part of the head to keep the hitting sound soft. However, in the 1990s, a golf club head made of a titanium alloy by the casting method made an appearance, and therefore the driver head became large in size. At that time, the head volume was about 250 cc. However, the material and manufacturing method of titanium alloy and the like have been improved, and at the present, a large head having a volume exceeding 400 cc appears. If the head size increases, the sweet area of head expands, so that a user-friendly golf club such that the decrease in carry is less even at an off-centered shot can be manufactured. However, if the head having a hollow part is made large, the thicknesses of members constituting a crown part and a sole part decrease, and also the area of the hollow part increases, which presents a problem in that the hitting sound becomes too soft.

Japanese Unexamined Patent Application Publication No. 2002-186691 describes a golf club head in which to make the hitting sound of a golf club head loud, in a hollow space of the golf club head, plate-shaped ribs are provided ranging from a sole part to a back face part.

On the other hand, various proposals for the configuration of a crown part of golf club head have been made.

For example, Japanese Unexamined Patent Application Publication No. 7-284546 describes a golf club head in which the wall thickness of a central part occupying a half or more of the total area of a crown part is made less than 1.2 mm, and the weight removed by this decreased thickness is distributed to other parts, by which the sweet area is expanded and the moment of inertia is increased. Also, Japanese Unexamined Patent Application Publication No. 2007-54198 describes a golf club head in which a thick-wall part is provided on the whole circumference of a crown part, on the inside thereof, a thin-wall part having a thickness smaller than that of the thick-wall part is provided, and the similar thick-wall part and thin-wall part are provided in both side parts on the toe side and the heel side, by which the delivery angle is increased, and thereby the carry is increased.

SUMMARY OF THE INVENTION

The present invention has been made in view of the above circumstances, and accordingly an object thereof is to provide a golf club head that produces a loud hitting sound satisfying the golfer even if the volume of golf club head having a hollow structure is increased to 400 cc or larger.

To achieve the above object, the present invention provides a golf club head having a hollow structure, wherein the head includes a hosel part, crown part, face part, sole part, and side part; the head is made of a metal, and the volume of the head is about 400 cc or larger; and the crown part is provided with a thin region and a thick region, the thick region of the crown part extending through a distance $W_A$ of at least about 20 mm from the center axis line C of a shaft insertion hole of the hosel part toward the highest point T of the crown part and extending through a distance $W_B$ of at least about 30 mm from the center axis line C of the shaft insertion hole of the hosel part toward the back side of the side part so that the first-order natural frequency of the crown part is about 3000 Hz or higher.

The golf club head is preferably configured by joining a body member provided with the sole part, the side part, the face part, and at least a part of the crown part having an opening and a crown member that closes the opening to each other, and the body member preferably has a partially thick structure ranging from the sole part to the side part or the face part. Alternatively, the golf club head is preferably configured by joining a body member provided with the sole part, the side part, the crown part, and at least a part of the face part having an opening and a crown member that closes the opening to each other, and the body member preferably has a partially thick structure ranging from the sole part to the side part or the face part.

The partially thick structure is preferably one rib or a plurality of ribs each having a shape extending substantially in the vertical direction from the inner surfaces of the sole part and the side part or face part. The horizontal length of the rib from the sole part to the side part or face part is preferably about 40 to 120 mm. The thickness of the rib in a tip end part on the head center side is preferably smaller than that in a part in which the rib is in contact with the inner surfaces of the sole part and the side surface or face part.

As the result of the studies conducted by the inventors, a knowledge was obtained that a large golf club having a head volume of about 400 cc or larger produces a soft sound due to the vibrations of the crown part when a ball is hit. According to the present invention, the thickness of the crown part of golf club head is changed so that the crown head has a thin region and a thick region having a different thickness, and the thick region is arranged in a predetermined region so that the first-order natural frequency of the crown part is about 3000 Hz or higher. Thereby, a loud hitting sound satisfying the golfer can be obtained even by the large golf club head having a head volume of about 400 cc or larger.

The studies revealed that in the crown part as well, the vibrations are especially large in the vicinity of the boundary position with the hosel part. Therefore, the thick region of the crown part is provided through a distance $W_A$ of at least about 20 mm from the center axis line C of the shaft insertion hole of the hosel part toward the highest point T of the crown part and also is provided through a distance $W_B$ of at least about 30 mm from the center axis line C of the shaft insertion hole of the hosel part toward the back side of the side part. Thereby, the rigidity in the vicinity of the boundary position with the hosel part is enhanced to restrain vibrations, and thereby the first-order natural frequency of the crown part can surely made 3000 Hz or higher.

Also, as the result of the studies conducted by the inventors, a knowledge was obtained that if the head volume is about 400 cc or larger, the first-order natural frequency of the sole part also decreases to about 2000 Hz, and a soft sound is sometimes produced in the sole part as well. Therefore, in the present invention, the golf club head is configured by joining the body member provided with the sole part, the side part, the face part, and at least a part of the crown part having the opening and the crown member that closes the opening to each other, and the body member has the partially thick structure ranging from the sole part to the side part or the face part. Thereby, the rigidity in the sole part is enhanced to improve the first-order natural frequency of the sole part, and thereby the hitting sound can be made louder.

DESCRIPTION OF THE PREFERRED EMBODIMENTS

Figure 1:
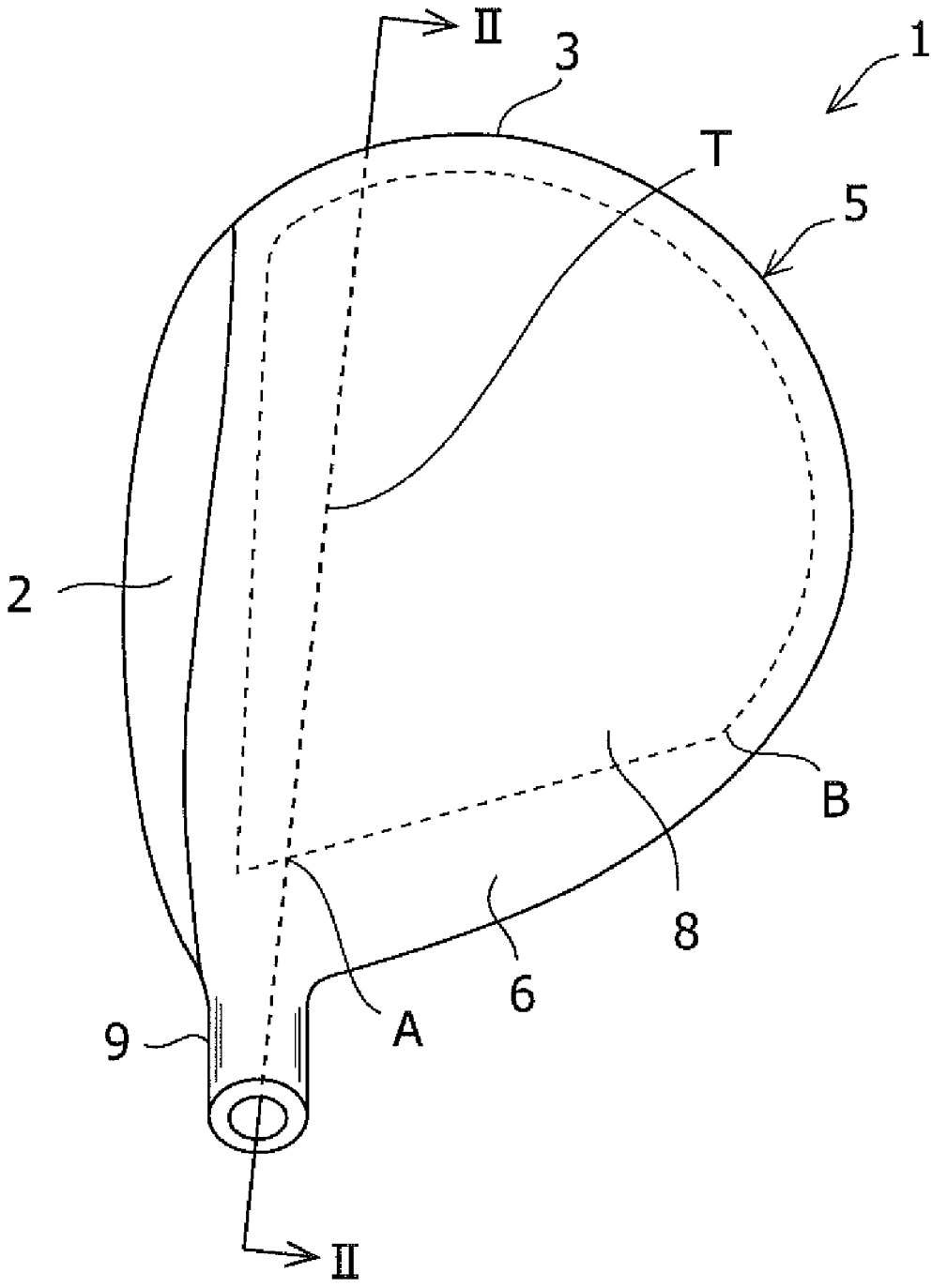
FIG. 1 is a plan view showing one embodiment of a golf club head in accordance with the present invention.
Figure 2:
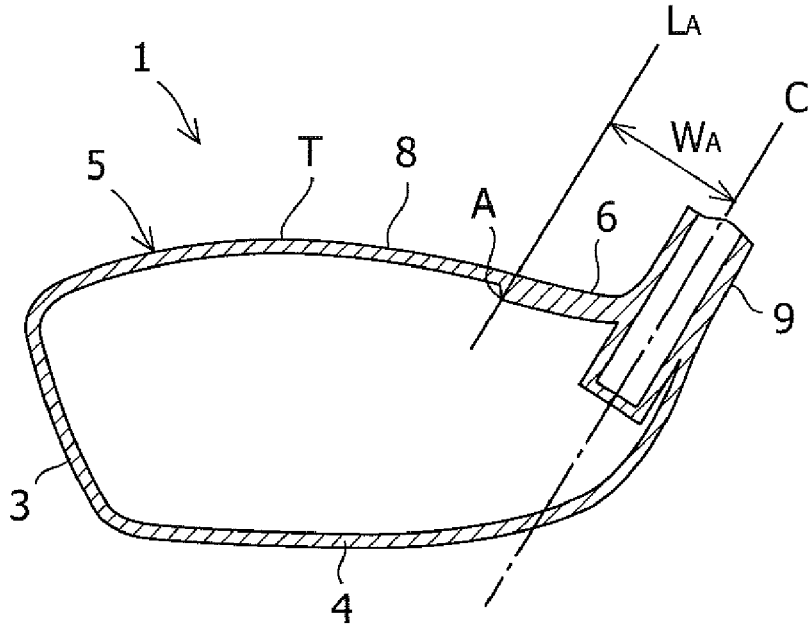
FIG. 2 is a sectional view taken along the line II-II of FIG. 1.
Figure 3:
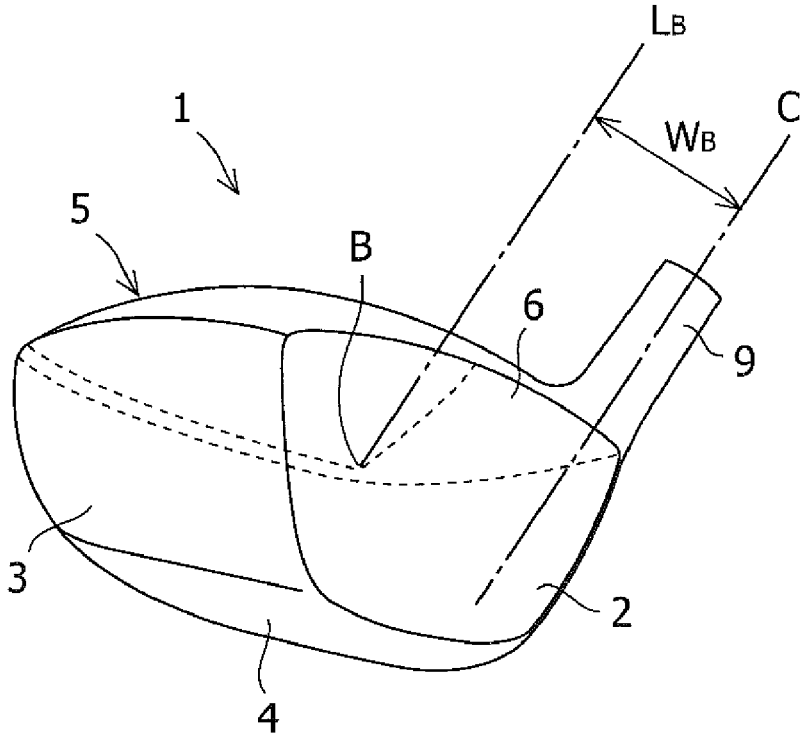
FIG. 3 is a perspective view of the golf club head shown in FIG. 1.

Embodiments of a golf club head in accordance with the present invention will now be described with reference to the accompanying drawings. FIG. 1 is a plan view showing one embodiment of a golf club head in accordance with the present invention. FIG. 2 is a sectional view taken along the line II-II of FIG. 1. FIG. 3 is a perspective view of the golf club head shown in FIG. 1.

As shown in FIGS. 1 to 3, a golf club head 1 of this embodiment includes a face part 2, a side part 3 rounding from the toe side to the heel side via the back side, a sole part 4, a crown part 5, and a hosel part 9. The crown part 5 has a region 6 adjacent to the hosel part 9 and the side part 3 on the heel side and a region 8 adjacent to the face part 2 and the side part 3 ranging from the toe side to the back side (indicated by a broken line in FIG. 1).

As shown in FIG. 2, the outside surface of the crown part 5 is flat, but the inside surface thereof has a shape such that the surface of the region 8 adjacent to the side part 3 on the heel side is depressed from the surface of the region 6 adjacent to the hosel part 9. That is to say, the thickness of the region 6 of the crown part 5 is larger than that of the central region 8 thereof.

The line II-II of FIG. 1 is a line passing through the center axis of a shaft insertion hole of the hosel part 9 and the highest point T of the crown part 5. The highest point T is the highest point of the crown part at the time when the golf club head 1 touches the ground at a lie angle of 60 degrees. FIG. 2 is a sectional view of the golf club head 1 taken along the line II-II. As shown in FIG. 2, the thick region 6 extends to an end part A toward the highest point T of the crown part 5. In this specification, the length to the end part A is specified by a distance $W_A$ between a line $L_A$ parallel to the center axis line C of the shaft insertion hole of the hosel part 9 and the center axis line C. According to the present invention, this distance $W_A$ must be about 20 mm or longer to restrain vibrations by increasing the rigidity of a portion near the hosel part of the crown part 5 and to make the first-order natural frequency of the crown part 5 about 3000 Hz or higher. A further preferable distance $W_A$ is about 25 mm or longer. On the other hand, this distance $W_A$ is preferably about 100 mm or shorter, further preferably about 90 mm or shorter, to prevent a too heavy head.

The thick region 6 is also adjacent to the side part 3 on the heel side. The thick region 6 extends to an end part B toward the side part 3. In this specification, the length to the end part B is specified by a distance $W_B$ between a line $L_B$ passing through the end part B and parallel to the center axis line C of the shaft insertion hole of the hosel part 9 and the center axis line C. According to the present invention, this distance $W_B$ must be about 30 mm or longer to restrain vibrations by increasing the rigidity of a portion near the hosel part of the crown part 5 and to make the first-order natural frequency of the crown part 5 about 3000 Hz or higher. A further preferable distance $W_B$ is about 35 mm or longer. On the other hand, this distance $W_B$ is preferably about 120 mm or shorter, further preferably about 100 mm or shorter, to decrease the head weight.

Thus, by increasing the thickness of the predetermined region 6 of the crown part 5, which is adjacent to the hosel part 9 and the side part 3 on the rear side, the rigidity of the predetermined region is enhanced to make it difficult to produce vibrations, by which the first-order natural frequency of the crown part 5 can be increased to about 3000 Hz or higher, and thereby soft hitting sound produced from the golf club head 1 can be improved. The first-order natural frequency of the crown part 5 is preferably about 5000 Hz or lower.

The thickness of the thin region 8 is preferably about 0.3 mm or larger, further preferably about 0.5 mm or larger. Also, the thickness of the thin region 8 is preferably about 1.0 mm or smaller, further preferably about 0.8 mm or smaller. The thickness of the thick region 6 is preferably about 0.20 mm or more larger, further preferably about 0.25 mm or more larger, than the thickness of the thin region 8 at the end part A. To prevent the weight from increasing, the difference in thickness between the thick region 6 and the thin region 8 is preferably about 3.0 mm or smaller, further preferably about 2.5 mm or smaller, in the end part A.

The hollow space in the golf club head 1 is formed by the inside surfaces of the face part 2, the side part 3, the sole part 4, and the crown part 5. The golf club head 1 in accordance with the present invention is a large-size head having a volume of about 400 cc or larger. The volume of the head is preferably about 420 cc or larger. On the other hand, the volume of the head is preferably about 500 cc or smaller, further preferably about 460 cc or smaller. Also, considering the swing balance of golf club, the weight of the head is preferably about 150 g or heavier and preferably about 250 g or lighter. If the golf club is a driver, the weight of the head is preferably about 170 g or heavier and preferably about 230 g or lighter.

To increase the moment of inertia and the volume, the area of the crown part 5 is preferably about 8000 $mm^2$ or larger. Also, to prevent a decrease in the natural frequency, the area of the crown part 5 is preferably about 17,000 $mm^2$ or smaller. To realize a light weight, the area of the thin region 8 is preferably about 3000 $mm^2$ or larger, further preferably about 4000 $mm^2$ or larger. Also, to secure the area of the thick region 6 and to improve the hitting sound, the area of the thin region 8 is preferably about 12,000 $mm^2$ or smaller, further preferably about 10,000 $mm^2$ or smaller.

As shown in FIG. 1, the shape of the thick region 6 of the crown part 5 ranging from the end part A to the end part B is a straight line shape. However, the shape thereof is not limited to this straight line shape. For example, the shape of the thick region 6 may be a curved line shape such as to be convex to the toe side. Also, as shown in FIG. 1, the thick region 6 extends toward the face part 2 side beyond the end part A and partially adjoins the face part 2 side. However, the shape of the thick region 6 in the direction toward the face part 2 side is not limited to this shape. The termination of the thick region 6 in the direction toward the face part 2 side may be the end part A.

Figure 4A:
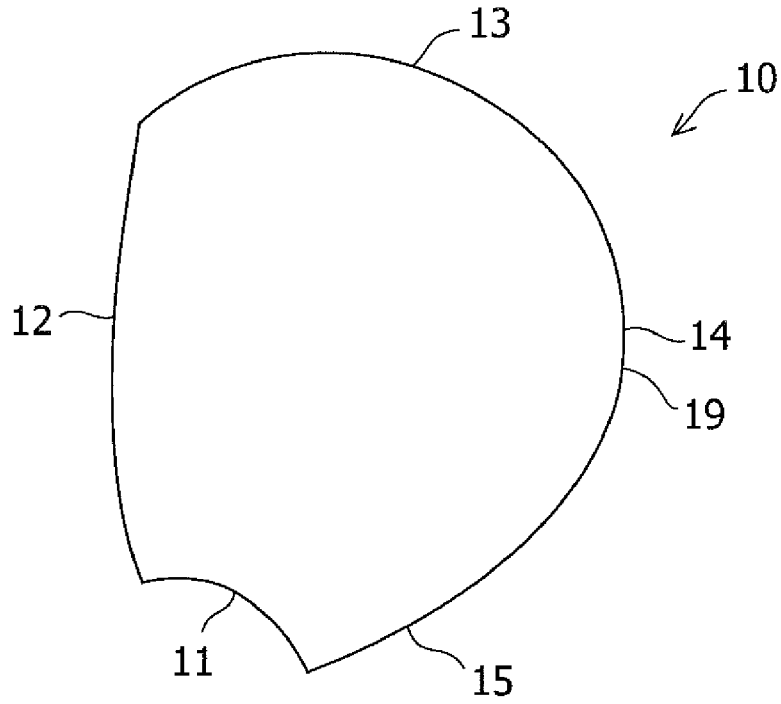
FIG. 4 is a plan view showing one embodiment of a crown member constituting a golf club head, showing another embodiment of a golf club head in accordance with the present invention.
Figure 4B:
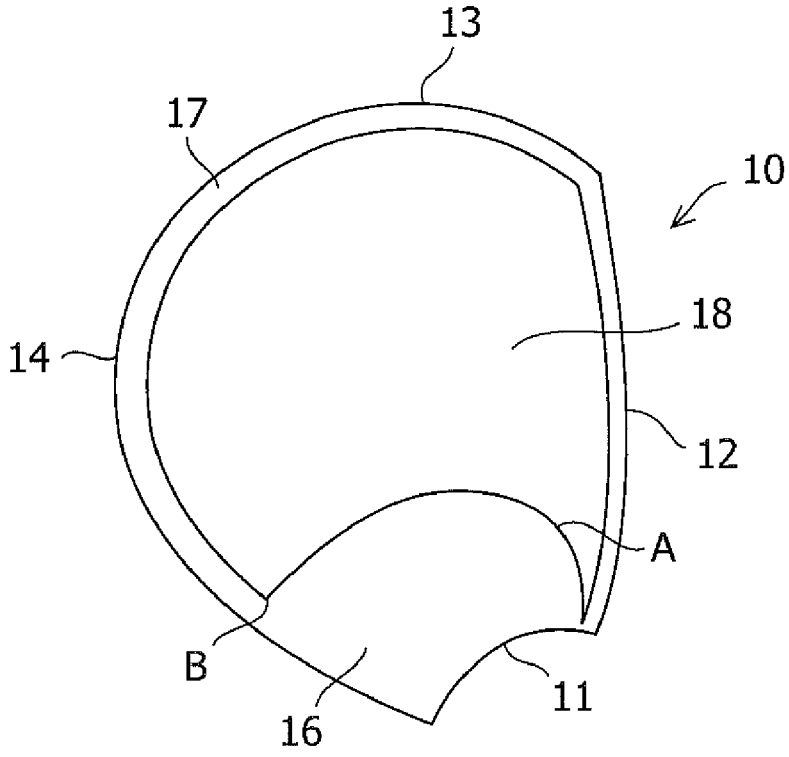
Figure 5:
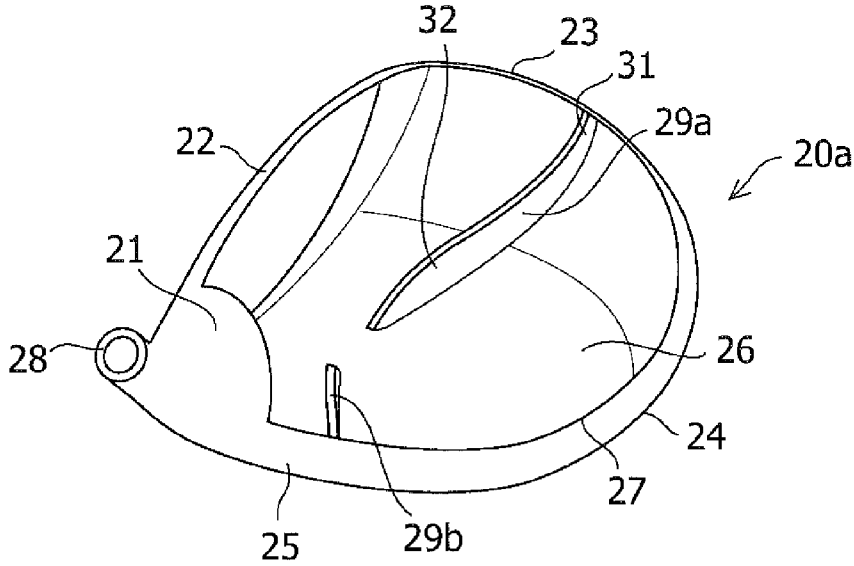
FIG. 5 is a perspective view showing one embodiment of a body member constituting a golf club head, showing another embodiment of a golf club head in accordance with the present invention.

Next, another embodiment of the golf club head is explained with reference to FIGS. 4 and 5. FIG. 4 is a plan view of a member constituting the crown part of the golf club head. FIG. 4*a* shows the outside surface of the member, and FIG. 4*b* shows the inside surface thereof. FIG. 5 is a perspective view of a body member of the golf club head.

As shown in FIG. 5, a body member 20 of the golf club head is provided with a crown flange 21 in the crown part, but other portions of the crown part form an opening 27. Also, the body member 20 includes a face part 22, side parts 23, 24 and 25 on the toe side, the back side, and the heel side, respectively, a sole part 26, and a hosel part 28. Also, a crown member 10 shown in FIG. 4 is formed so as to close the opening 27 of the body member 20. That is to say, the golf club head of this embodiment is configured by joining the crown member 10 to the body member 20. The crown part of this golf club head is formed by the crown member 10 and the crown flange 21 of the body member 20.

The outer peripheral edge of the crown member 10 consists of an edge 11 on the hosel side, an edge 12 on the face side, an edge 13 on the toe side, an edge 14 on the back side, and an edge 15 on the heel side. The edge 11 on the hosel side has a concave arcuate or curved shape corresponding to the approximately arcuate or curved edge of the crown flange 21 so as to be joined to the edge of the crown flange 21 of the body member 20. The edge 12 on the face side is joined to the upper end of the face part 22. The edges 13, 14 and 15 are joined to the upper ends of the side parts 23, 24 and 25 on the toe side, the back side, and the heel side, respectively. That is to say, the edge 12 on the face side approximately corresponds to the ridge line of the face part and the crown part of head, and the edges 13, 14 and 15 on the toe side, the back side, and the heel side, respectively, approximately correspond to the ridge line of the side part and the crown part of head.

As shown in FIG. 4*a*, an outside surface 19 of the crown member 10 is flat. On the other hand, as shown in FIG. 4*b*, the inside surface of the crown member 10 has a shape such that the surface of a central region 18 surrounded by an outer edge portion is depressed from the surfaces of outer edge regions 16 and 17 of the member. That is to say, the thicknesses of the outer edge regions 16 and 17 of the crown member 10 are larger than the thickness of the central region 18 thereof. The crown flange 21 of the body member 20 has a large thickness like the outer edge regions 16 and 17 of the crown member 10.

The region 16 adjacent to the edge 11 on the hosel side of the crown member 10 forms a thick region, in which the first-order natural frequency of the crown part in accordance with the present invention is as high as about 3000 Hz or higher, in combination with the crown flange 21 of the body member 20. The shape of the thick region on the hosel side ranging from an end part A to an end part B is a curved shape that is convex to the toe side.

To join the crown member 10 to the body member 20, the crown member 10 is provided with the thick region 17 on the face side 12, the toe side 13, the back side 14, and the heel side 15. The thick region 17 preferably has an almost uniform and narrow width. The width of the slender and thick region 17 is preferably about 3 mm or wider, further preferably about 5 mm or wider. If the width of the slender and thick region 17 is too wide, the area of the thin central region 18 decreases. Therefore, the width of the slender and thick region 17 is preferably about 15 mm or narrower, further preferably about 10 mm or narrower.

In particular, the thickness of the thick region 16 on the hosel side exerts a great influence on the first-order natural frequency of the crown part as described above. Therefore, the thickness of the thick region 16 is preferably about 0.1 mm or more larger, further preferably about 0.2 mm or more larger, than the thickness of the thick region 17 at the outer periphery. To prevent the weight from becoming too heavy, the difference in thickness between the thick regions 16 and 17 and the thin region 18 is preferably about 3 mm or smaller, further preferably about 2 mm or smaller.

In addition to the above-described construction of the crown part, the sole part 26 also preferably employs a construction that improves the first-order natural frequency of the sole part. Usually, as the width and length of the sole part 26 increase, the first-order natural frequency of the sole part 26 decreases. Therefore, even if the head size decreases, the first-order natural frequency of the sole part 26 can be enhancedly improved by employing a construction that enhances the rigidity of the sole part 26. As such a construction, a construction in which the thickness is increased partially ranging from the sole part to the side parts or the face part is available. In particular, as shown in FIG. 5, a construction in which ribs 29 are provided on the inner surfaces of both of the sole part 26 and the side parts of the body member 20 is preferable.

Figure 6:
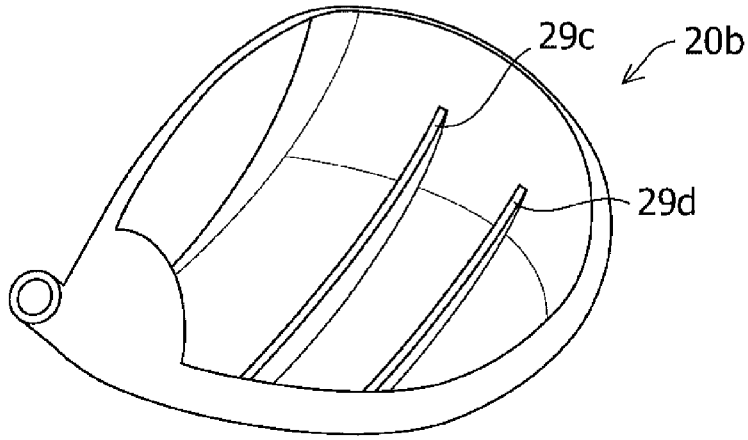
FIG. 6 is a perspective view showing another embodiment of a body member constituting a golf club head in accordance with the present invention.
Figure 7:
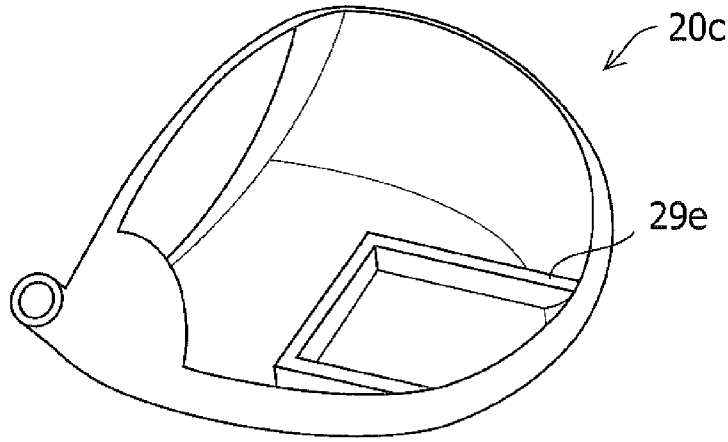
FIG. 7 is a perspective view showing still another embodiment of a body member constituting a golf club head in accordance with the present invention.

In the embodiment shown in FIG. 5, two ribs are provided. One is a rib 29*a* provided on the inner surfaces of both of the sole part 26 and the side part 23 on the toe side, and the other is a rib 29*b* provided on the inner surfaces of both of the sole part 26 and the side part 25 on the heel side. The arrangement of the ribs is not limited to this arrangement. For example, as shown in FIG. 6, a rib 29*c* on three inner surfaces of the side part 23 on the toe side, the sole part 26, and the side part 25 on the heel side can be provided. Also, as shown in FIG. 7, a rib 29*e* on the inner surfaces of both of the sole part 26 and the side part 24 on the back side can also be provided.

The rib 29 preferably extends substantially in the vertical direction from the inner surface of the sole part 26 when the head is placed at the normal address position. The height of the rib 29 from the inner surface of the sole part 26 is preferably about 2 mm or larger. Also, the height of the rib 29 is preferably about 5 mm or smaller. The number of ribs 29 may be one or may be plural. The number of ribs 29 is preferably one to seven, further preferably one to three. The rib 29 may have a shape extending in the straight line shape along the inner surfaces of the sole part and the side part as shown in FIGS. 5 and 6, or may have a U shape as shown in FIG. 7. Also, preferably, as shown in FIG. 5, a plurality of ribs extend radially from the side parts toward the center of the sole part 26.

Regarding the length of the rib 29, it is preferable that the length at a fixed end 31 that is in contact with the inner surfaces of the sole part and the side part be shorter than the length at a free end 32 positioned on the opposite side of the fixed end, that is, the length at the tip end on the head center side. By this configuration, the fluidity of molten metal at the time of manufacture can be made higher. The length in the horizontal direction of the rib 29 is preferably about 40 mm or longer. Thereby, the sound can be improved effectively. The length of the rib 29 is further preferably about 45 mm or longer. On the other hand, the length of the rib 29 is preferably about 120 mm or shorter, further preferably about 100 mm or shorter.

The thickness of the rib 29 in a part that is in contact with the inner surface of the sole part 26 or the side part is preferably about 1 mm or larger, further preferably about 2 mm or larger. Also, the thickness of the rib 29 in a part that is in contact with the inner surface thereof is preferably about 5 mm or smaller, further preferably about 3 mm or smaller. If the thickness of the rib 29 is too small, misrun occurs at the time of pouring of molten metal, which presents a problem of broken rib or the like. On the other hand, if the thickness of the rib 29 is too large, the rib becomes heavy in weight, which presents a problem in that the increase in size of head is hindered, or the weight of head increases.

Regarding the thickness of the rib 29, it is preferable that the thickness of the tip end part on the head center side be smaller than the thickness of a part that is in contact with the inner surfaces of the sole part 26 and the side part. By this configuration, the flow of molten metal to the rib 29 at the time when the body member is cast can be made better. Also, by this configuration, the moment of inertia of the head can be increased because the center of gravity of the golf club head shifts to the back side. For example, the thickness of the tip end part of the rib 29 can be made about 0.1 mm or more smaller, preferably about 0.5 mm or more smaller, than the thickness of the outside part of the rib 29. The thickness of the sole part 26 is preferably about 0.5 mm or larger, further preferably about 0.7 mm or larger. Also, the thickness of the sole part 26 is preferably about 2.0 mm or smaller, further preferably about 1.5 mm or smaller.

The manufacturing method of the crown part 10 is not subject to any special restriction. The crown part 10 can be manufactured by casting or press molding. The thin region 18 of the crown part 10 can be formed by acid cleaning (acid milling) the thin region 18 after parts other than the region 18 have been masked.

The body member 20 is preferably formed integrally by casting to arrange the ribs 29 in the sole part 26. Also, the body member 20 can also manufactured by press molding the face part, side parts, sole part, and ribs of the body member and by fixing these press molded elements by welding. In the case where the rib is welded to the inner surface of the sole part, if depressions such as numerals indicating a gage number or the like, trade name, trademark, or decorative design are present at a position on the outer surface of the sole part on the back side of the welded surface, the member metal melts and the numerals and letters, and the decorative design may be distorted. In this case, it is preferable that the positions of numerals and the like be shifted, or the body member be manufactured by casting.

The joining method of the face member 10 and the body member 20 is not subject to any special restriction. The face member 10 and the body member 20 are preferably joined to each other by welding or the like. The face member 10 and the body member 20 can be manufactured of metallic materials having the same or different composition. The face member 10 is preferably manufactured of a titanium alloy or an aluminum alloy. As the material of the face member 10, for example, a titanium alloy (Ti-6Al-4V) having a composition of 5.5 to 6.75 wt % Al, 3.5 to 4.5 wt % V, the balance being Ti and unavoidable impurities or AMS-A201 (aluminum alloy) can be used. Also, the body member 20 is preferably manufactured of a titanium alloy, aluminum alloy, or magnesium alloy, and, for example, the aforementioned Ti-6Al-4V alloy can be used.

In the embodiment shown in FIGS. 4 to 7, an opening is provided in the crown part of the body member of golf club head, and this opening is closed by the crown member. However, the configuration of the golf club head is not limited to this configuration. For example, the configuration can be made such that an opening is provided in the face part of the body member of golf club head, and this opening is closed by a face member. In this case, to increase the first-order natural frequency of the crown part to about 3000 Hz or higher, the thickness of a predetermined region adjacent to the hosel part and the side part on the heel side of the crown part of the body member is increased. Also, to join the face member to the crown part, a thick region having an almost uniform and narrow width is preferably provided on the face side of the crown part.

EXAMPLES

Golf club heads of examples 1 to 8 and comparative example having the specifications given in Table 1 were manufactured, and the natural frequencies of these golf club heads were determined by FEM analysis. In any of examples 1 to 8 and comparative example, the Ti-6Al-4V alloy was used, and the volume of head was set at 452 cc, the thickness of face part at 3 mm, the thickness of sole part at 0.8 mm, the thickness of side part at 0.7 mm, the area of sole part at 6932 $mm^2$, and the area of crown part at 11,597 $mm^2$.

The heads of examples 1 to 3 were provided with the rib configurations in the sole part as shown in FIGS. 5 to 7, respectively. In example 1, two types of ribs each having a length of 57 mm and 66 mm were used. In example 2, two types of ribs each having a length of 105 mm and 82 mm were used. In example 3, a U-shaped rib whose length in the toe-to-heel direction was 50 mm and whose length in the face-to-back side direction was 45 mm was used. In any of these examples, the height of rib was set at 7 mm, and the thickness of rib was set at 3 mm. For any of the heads in examples 1 to 3, the shape of the thin region of the crown part was as shown in FIG. 4 (the distance $W_A$ was 47 mm, and the distance $W_B$ was 57 mm). The thickness of the crown part was set at 0.7 mm on the average.

Figure 8:
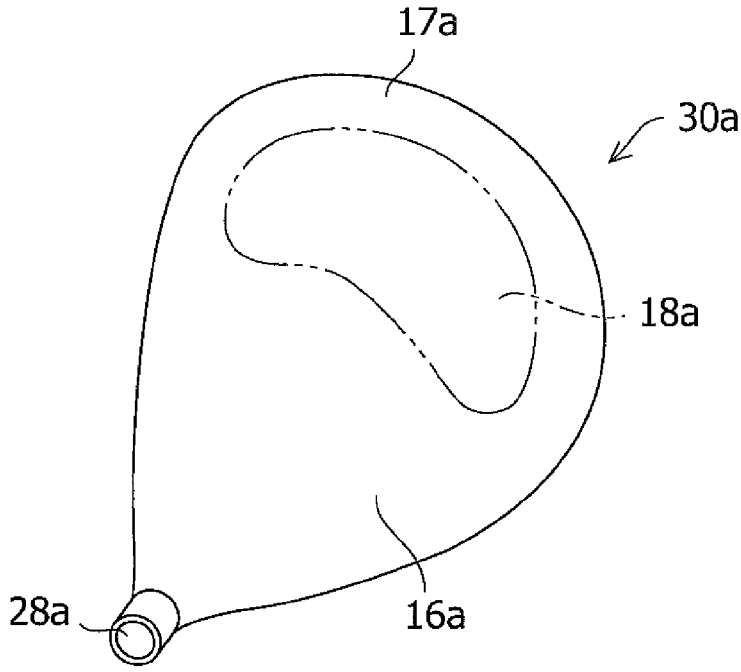
FIG. 8 is a plan view showing still another embodiment of a golf club head in accordance with the present invention.
Figure 9:
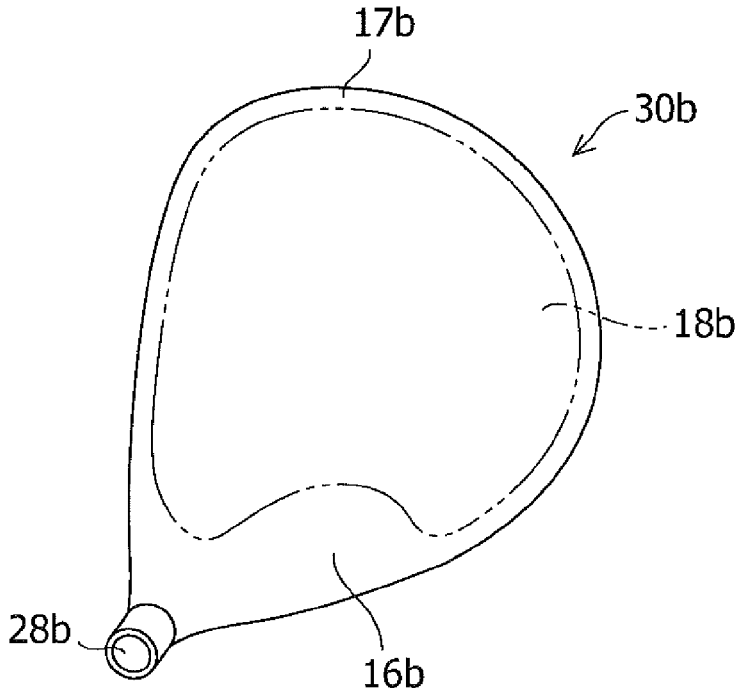
FIG. 9 is a plan view showing yet another embodiment of a golf club head in accordance with the present invention.

In examples 4 to 6, the thickness of the thin region of the crown part was changed in the head of example 2. Also, in examples 7 and 8, the shapes of the thin region and thick region of the crown part were changed in the head of example 2. In example 7, a thick region 16*a* on the hosel side was widened (the distance $W_A$ was 20 mm, and the distance $W_B$ was 75 mm), and a thin region 18*a* was narrowed as shown in FIG. 8. In example 8, a thick region 16*b* on the hosel side was narrowed (the distance $W_A$ was 90 mm, and the distance $W_B$ was 100 mm), and a thin region 18*b* was widened as shown in FIG. 9.

Figure 10A:
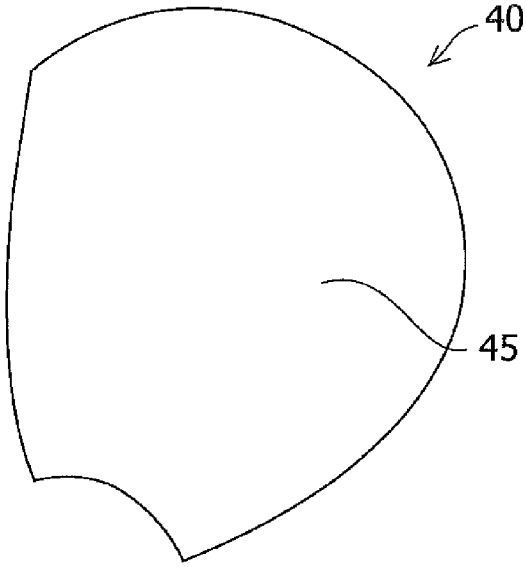
FIG. 10 is a plan view of a crown member constituting a golf club head of a comparative example.
Figure 10B:
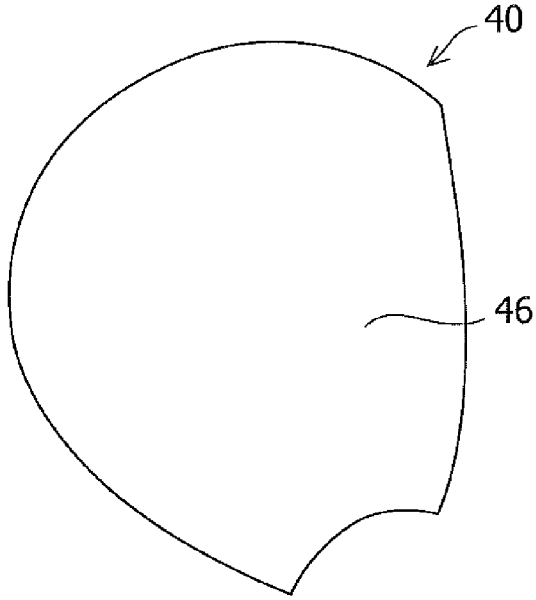
Figure 11:
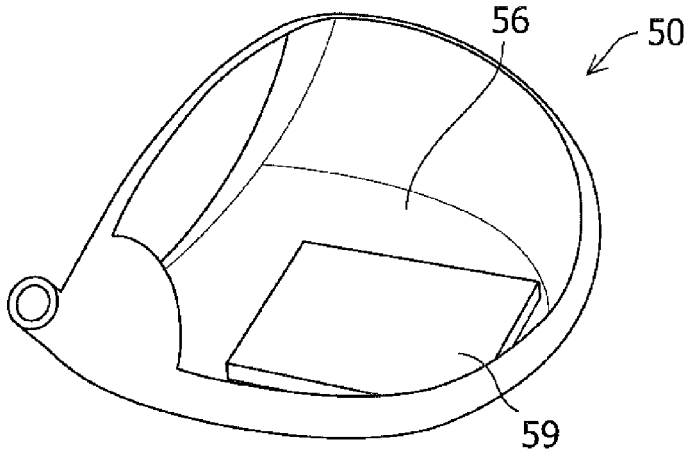
FIG. 11 is a perspective view of a body member constituting a golf club head of a comparative example.

The head of comparative example was manufactured by welding a face member 40 both of an outer surface 45 and an inner surface 45 of which were flat as shown in FIGS. 10*a* and 10*b* to a rib-less body member 50 shown in FIG. 11. In a sole part 56 of comparative example, as shown in FIG. 11, a thick part 59 having a length in the toe-to-heel direction of 35 mm, a width in the face-to-back side direction of 60 mm, a thickness of 2.2 mm, and a weight of 22 g was provided to adjust the weight. The FEM analysis results are shown in FIGS. 12 to 20. FIGS. 12 to 20 are diagrams in which the magnitude of amplitude of the head is represented by the depth of color. The darker color represents larger amplitude.

TABLE 1

| | | Comparative example | Examples 1 | 2 | 3 | 4 | 5 | 6 | 7 | 8 |
|---|---|---|---|---|---|---|---|---|---|---|
| Weight [g] | | 189.6 | 188.3 | 190.2 | 187.6 | 188.2 | 187.8 | 188.4 | 188.8 | 187.9 |
| Rib configuration in sole part | | — | FIG. 5 | FIG. 6 | FIG. 7 | FIG. 6 | FIG. 6 | FIG. 6 | FIG. 6 | FIG. 6 |
| Area of thin region [$mm^2$] | | — | 8400 | 8400 | 8400 | 8400 | 8400 | 8400 | 3001 | 10335 |
| Thickness of thick region [mm] | | 0.7 | 1.3 | 1.3 | 1.3 | 1.2 | 1.2 | 1.2 | 1.2 | 1.5 |
| Thickness of thin region [mm] | | 0.7 | 0.5 | 0.5 | 0.5 | 0.6 | 0.8 | 1.0 | 1.0 | 0.5 |
| FEM Analysis Result [Hz] | Primary mode | (s) 2126 | (s) 2505 | (s) 2683 | (s) 2368 | (s) 2671 | (s) 2663 | (s) 2655 | (s) 2652 | (s) 2693 |
| | Secondary mode | (c) 2476 | (s) 2639 | (c) 3043 | (s) 2648 | (c) 3007 | (c) 3026 | (c) 3037 | (c) 3107 | (c) 3133 |
| | Primary mode | — | (c) 3011 | — | (c) 3001 | 3719 | 3716 | 3714 | — | — |

In the FEM analysis results, the (s) value denotes the first-order natural frequency of the sole part, and the (c) value denotes the first-order natural frequency of the crown part.

Figure 20A:
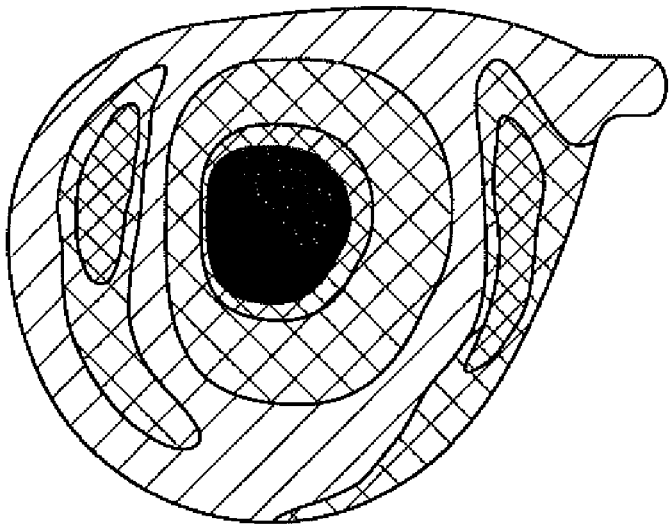
FIG. 20 is a diagram showing a FEM analysis result of amplitude of a golf club head of comparative example.
Figure 20B:
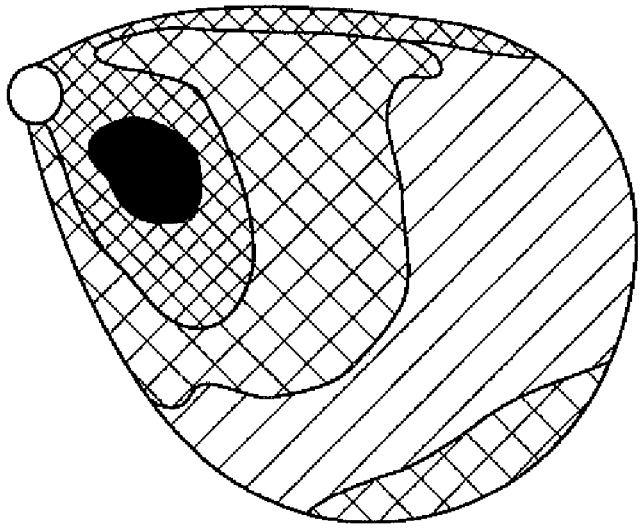

In comparative example, as given in Table 1, the first-order natural frequency of the sole part was 2126 Hz, and the first-order natural frequency of the crown part was 2476 Hz. As shown in FIG. 20*a*, the amplitude was large over a wide range from the center of the sole part. Also, as shown in FIG. 20*b*, the amplitude was the largest in a part adjacent to the hosel part of the crown part.

Figure 12A:
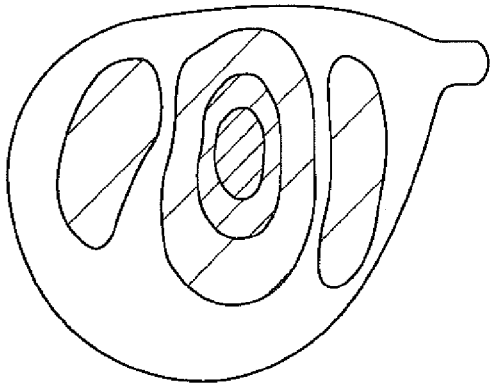
FIG. 12 is a diagram showing a FEM analysis result of amplitude of a golf club head of example 1.
Figure 12B:
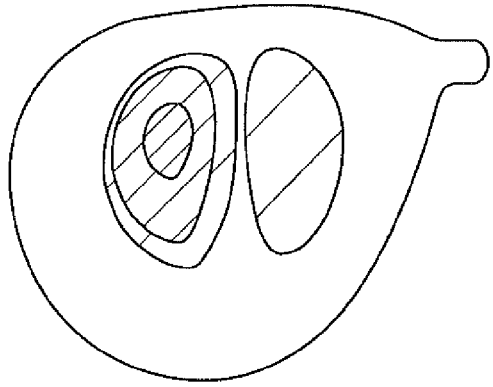
Figure 12C:
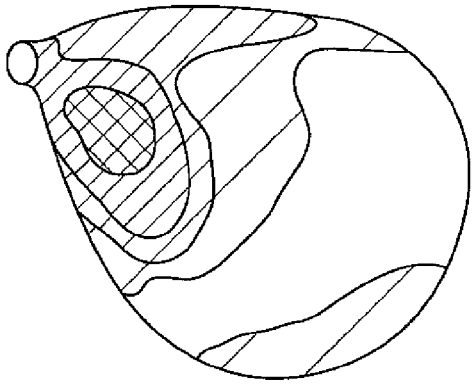

On the other hand, in example 1, as given in Table 1, both of the first-order natural frequency of the sole part and the first-order natural frequency of the crown part were improved greatly, the former being 2505 Hz, and the latter being 3011 Hz. As shown in FIGS. 12*a* and 12*b*, the amplitude was kept small by two ribs. Also, as shown in FIG. 12*c*, the amplitude was the largest in a part adjacent to the hosel part of the crown part as in comparative example, but the amplitude was kept small as a whole.

Figure 13:
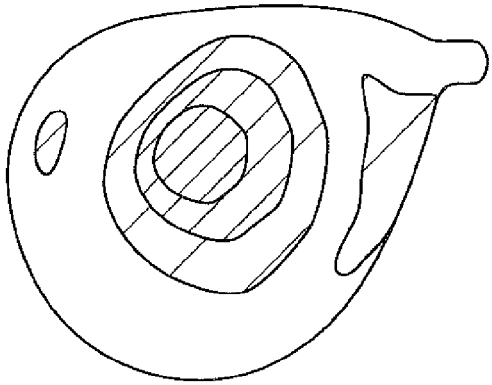
FIG. 13 is a diagram showing a FEM analysis result of amplitude of a golf club head of example 2.
Figure 14:
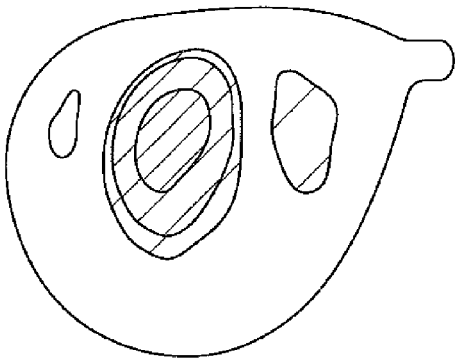
FIG. 14 is a diagram showing a FEM analysis result of amplitude of a golf club head of example 3.
Figure 15:
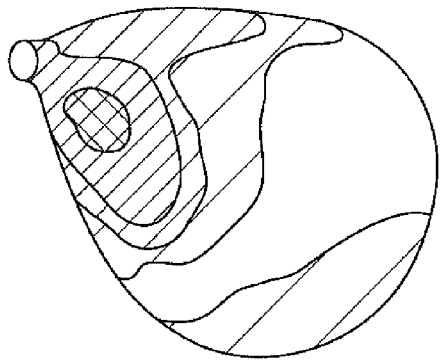
FIG. 15 is a diagram showing a FEM analysis result of amplitude of a golf club head of example 4.
Figure 16:
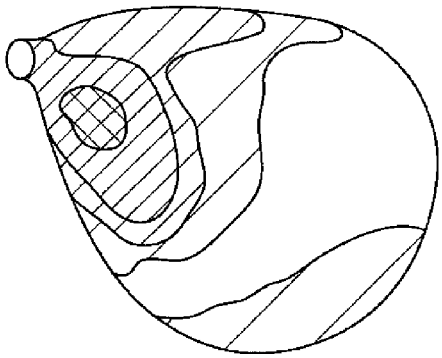
FIG. 16 is a diagram showing a FEM analysis result of amplitude of a golf club head of example 5.
Figure 17:
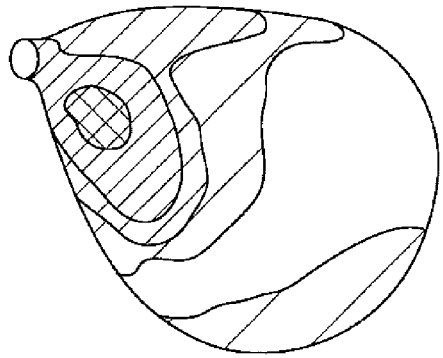
FIG. 17 is a diagram showing a FEM analysis result of amplitude of a golf club head of example 6.
Figure 18:
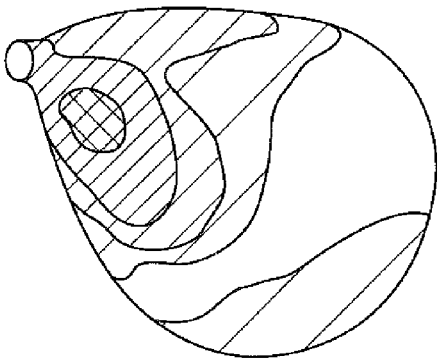
FIG. 18 is a diagram showing a FEM analysis result of amplitude of a golf club head of example 7.
Figure 19:
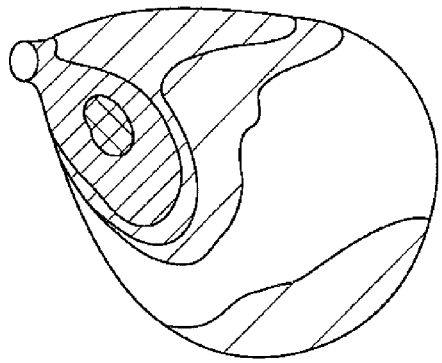
FIG. 19 is a diagram showing a FEM analysis result of amplitude of a golf club head of example 8.

In example 2 in which the ribs extending from the toe side to the heel side are provided, as given in Table 1, the first-order natural frequency of the sole part was further improved, being 2683 Hz, as compared with example 1 in which the ribs are provided separately on the toe side and the heel side. As shown in FIG. 13, in example 2, the amplitude was kept uniform over the whole of the sole part. Also, in example 3 in which the rib is provided on the back side, the first-order natural frequency of the sole part was 2368 Hz, which did not run up to the values in examples 1 and 2. As shown in FIG. 14, for the rib of example 3, the amplitude was kept small mainly on the back side.

In examples 4 to 6 in which the thickness of thin region of the crown part was changed, the first-order natural frequencies of the crown part were 3007 Hz, 3026 Hz, and 3037 Hz in the order of decreasing thickness. Also, in example 7 in which the thick region of the crown part was widened, the first-order natural frequency of the crown part was further improved, being 3107 Hz, as compared with examples 1 to 6. Further, in example 8 as well, in which the thick region of the crown part was widened, the first-order natural frequency of the crown part was further improved, being 3133 Hz, as compared with examples 1 to 6. The reason for this is thought to be that the first-order natural frequency was improved by the increase in thickness caused by the decrease in area of the thick region. As shown in FIGS. 15 to 19 showing the analysis results of examples 4 to 8, in examples 4 to 8 as well, the amplitude was kept small as a whole as in example 1.

What is claimed is:

1. A golf club head having a hollow structure, which is made of a metal and has a volume of at least about 400 cubic centimeters, comprising:

a hosel part having a shaft insertion hole;

a crown part comprising a thin region and a thick region and having an area of about 8000 $mm^2$ to about 17,000 $mm^2$;

a face part, a sole part, and a side part comprising a back side;

wherein the thick region of the crown part extends through a distance WA of about 20 millimeters to about 100 millimeters from a center axis line C of the shaft insertion hole toward the highest point T of the crown part and extends through a distance WB of at least about 30 millimeters from the center axis line C toward the back side so that the crown part has a first-order natural frequency of at least about 3000 hertz.

2. The golf club head according to claim 1, wherein the golf club head comprising:

a body member comprising the sole part, the side part, the face part, and at least a part of the crown part having an opening; and a crown member which closes the opening and is joined to the body member, wherein the body member has a partially thick structure extending from the sole part to the side or face part.

3. The golf club head according to claim 2, wherein the partially thick structure is one rib or a plurality of ribs each having a shape extending substantially in a vertical direction from inner surfaces of the sole part and the side part or face part.

4. The golf club head according to claim 3, wherein a horizontal length of the rib from the sole part to the side part or face part is at least about 40 millimeters.

5. The golf club head according to claim 3, wherein a thickness of the rib in a tip end part on a head center side is smaller than that in a part in which the rib is in contact with the inner surfaces of the sole part and the side part or face part.

6. The golf club head according to claim 1, wherein the golf club head comprising;

a body member comprising the sole part, the side part, the crown part, and at least a part of the face part having an opening; and a face member which closes the opening and is joined to the body member, wherein the body member has a partially thick structure extending from the sole part to the side or face part.

7. The golf club head according to claim 6, wherein the partially thick structure is one rib or a plurality of ribs each having a shape extending substantially in a vertical direction from inner surfaces of the sole part and the side part or face part.

8. The golf club head according to claim 7, wherein a thickness of the rib in a tip end part on a head center side is smaller than that in a part in which the rib is in contact with the inner surfaces of the sole part and the side part or face part.

9. The golf club head according to claim 1, wherein the crown part further comprises an additional thick region adjacent to a face side, a toe side, and the back side of the head, the additional thick region having an almost uniform and narrow width.

10. The golf club head according to claim 9, wherein the width of the additional thick region is narrower than a width of the thick region extending through the distance WB from the center axis line C toward the back side.

11. A golf club head having a hollow structure, which is made of a metal and has a volume of at least about 400 cubic centimeters, comprising:

a hosel part having a shaft insertion hole;

a crown part comprising a thin region and a thick region;

a face part;

a sole part;

a side part comprising a back side; and at least one rib having a shape extending substantially in a vertical direction from the inner surfaces of the sole part and the side part or face part, wherein the thickness of the rib in a tip end part on a head center side is smaller than that in a part in which the rib is in contact with the inner surfaces of the sole part and the side part or face part, and wherein the thick region of the crown part extends through a distance WA of at least about 20 millimeters from a center axis line C of the shaft insertion hole toward the highest point T of the crown part and extends through a distance WB of at least about 30 millimeters from the center axis line C toward the back side so that the crown part has a first-order natural frequency of at least about 3000 hertz.

12. The golf club head according to claim 11, wherein the golf club head further comprises:

a body member comprising the sole part, the side part, the face part, and at least a part of the crown part having an opening; and a crown member which closes the opening and is joined to the body member.

13. The golf club head according to claim 11, wherein the golf club head further comprises:

a body member comprising the sole part, the side part, the crown part, and at least a part of the face part having an opening; and a face member which closes the opening and is joined to the body member.

14. The golf club head according to claim 11, wherein a horizontal length of the rib from the sole part to the side part or face part is at least about 40 millimeters.

15. The golf club head according to claim 11, wherein the crown part further comprises an additional thick region adjacent to a face side, a toe side, and the back side of the head, the additional thick region having an almost uniform and narrow width.

16. The golf club head according to claim 15, wherein the width of the additional thick region is narrower than a width of the thick region extending through the distance WB from the center axis line C toward the back side.

* * * * *